US005394058A

United States Patent [19]

Rolski et al.

[11] Patent Number: 5,394,058

[45] Date of Patent: Feb. 28, 1995

[54] GAS DISCHARGE LAMP HAVING A WATER VAPOR ENRICHED FILL

[75] Inventors: Andrezej M. Rolski, Kriftel; Michael Zöchbauer, Oberursel, both of Germany

[73] Assignee: Hartmann & Braun, Hanover, Germany

[21] Appl. No.: 976,473

[22] Filed: Nov. 16, 1992

[30] Foreign Application Priority Data

Nov. 22, 1991 [DE] Germany ..... 4138425

[51] Int. Cl.[6] ..... H01J 17/00; H01J 61/10

[52] U.S. Cl. ..... 313/637; 313/547; 313/550; 313/632

[58] Field of Search ..... 313/547, 550, 551, 573, 313/574, 632, 634, 637

[56] References Cited

U.S. PATENT DOCUMENTS 2,103,039 12/1937 Pirani et al. ..... 313/547

FOREIGN PATENT DOCUMENTS 2246365 5/1975 Germany .
2546565 10/1977 Germany .
2541162 5/1981 Germany .

*Primary Examiner*—Donald J. Yusko
*Assistant Examiner*—N. D. Patel

[57] ABSTRACT

A sealed gas discharge lamp is filed with a water vapor-enriched low pressure nitrogen oxygen mixture and a storage medium such as manganese dioxide is included in a separate vessel of the lamp for additionally storing water vapor but releasing the water vapor as the pressure in the lamp drops, the release may be augmented by heating the storage medium.

8 Claims, 1 Drawing Sheet

GAS DISCHARGE LAMP HAVING A WATER VAPOR ENRICHED FILL

BACKGROUND OF THE INVENTION

The present invention relates to a tightly sealed gas discharge lamp filled with a nitrogen oxygen mixture, the gas being held in the lamp at low pressure; an electric discharge current flows through such a lamp during operation.

Gas discharge lamps of the kind to which the invention pertains are used for example in photometers for determining, i.e. measuring the concentration of components in a gas mixture. For example, nitric oxide (NO) or sulfur dioxide $SO_2$ absorb light in the range of ultraviolet radiation from 200 to 600 nm emitted from such a lamp. Usually the gas discharge lamps are constructed as hollow cathode lamps.

German patent 25 41 162 discloses a photometer for measuring the concentration of nitric oxide. This photometer includes a gas discharge lamp constructed as a hollow cathode lamp filled with low pressure air and operated with a low level discharge current. Further included is a radiation detector for receiving the nitric oxide resonance radiation emitted by the lamp after such radiation has passed through the gas mixture. The lamp consists of a vessel containing gas which is tightly sealed and under pressure of from 1 to 5 mbar. Such a hollow cathode lamp has a very short use life of its nitric oxide radiation owing to the consumption of oxygen of the air filling so that such a lamp is useful at best in laboratories but without further features cannot be used in a practical sense in industrial applications. Although increasing the air pressure does increase the use life of the nitric oxide radiation, the intensity of that radiation is reduced.

German patent 25 46 565 discloses another photometer that also uses a hollow cathode lamp as gas discharge lamp and radiation source. This particular photometer is primarily designed for measuring the content of sulfur dioxide in a gas mixture. However, certain features of that photometer permit its use for additionally measuring the content of nitric oxide in a gas mixture. The hollow cathode lamp is filled here with a dry nitrogen oxygen mixture, and after falling it is closed off by a melting and sealing process. The use life of this lamp is likewise short as far as nitric oxide radiation is concerned, particularly for measuring the concentration of nitric oxide, owing to the consumption of oxygen during operation of the lamp so that again such a lamp can be used only in lab- equipment; additional features are needed to expand its use to industrial applications.

It has thus been recognized that the low or short use life of the nitric oxide radiation of a hollow cathode lamp as known from the literature above is the result of the oxygen consumption and that is the reason for limiting industrial applications; this effect is particularly noticeable when using an ultra violet spectral range from 200 to 300 nm. In order to offset this limitation, replenishing the oxygen content by means of an oxygen-releasing substance has been tried. There was the underlying belief that oxygen can be produced by the decomposition of metal oxides such as manganese dioxide. The above-cited German printed patent application discloses such a lamp. This particular hollow cathode lamp is filled with a nitrogen oxygen mixture at a low pressure and is gas tightly sealed. The inclusion of a certain amount of metal oxide in the lamp is supposed to offset to some extent the gas consumption. However, it was found that the oxygen yield at the operating temperature of that lamp is too small and will not sufficiently replenish the oxygen consumption. The same is true as far as the effect of the low pressure in the lamp is concerned; it just does not suffice to do the job.

Additionally reference is made to U.S. Pat. No. 3,947,685 being a kind of continuation case for German patent 22 46 365.

DESCRIPTION OF THE INVENTION

It is an object of the present invention to provide a new and improved gas discharge lamp that contains a low pressure nitrogen oxygen mixture in that the use life of the lamp is increased particularly for using the lamp for measuring gas concentrations under utilization of nitric oxide radiation in the spectral range from 200 to 300 nm.

In accordance with the preferred embodiment of the present invention it is suggested to enrich the interior of the lamp with water vapor and particularly, a water vapor moistened storage medium is included in the lamp for releasing water vapor when the pressure in the lamp drops. Hence the use life of the lamp is extended by storing the oxygen-to-be replenished in the form of water vapor. Only after the lamp is operated will the discharge zone produce the replenishing oxygen. Hence the invention is based on the concept of storing oxygen not directly but as a constituent of water vapor and to extract the oxygen therefrom only after the oxygen consuming operation has begun.

Storing oxygen indirectly through water vapor offers the advantage that even at the low lamp pressure of 10 mbars or thereabouts sufficient water vapor is made available so that the photometer can be operated for about a year and the same lamp may still be used to measure the concentration of nitric oxide. The lamp is preferably a hollow cathode lamp and the preferred pressure range is 5 to 20 mbar. This pressure range is just a little above, the conventional range for such a lamp but has been found to decrease the radiation intensity only to an insignificant extent.

One will preferably use manganese dioxide as water vapor storing medium. Manganese dioxide as a water vapor storing medium is of advantage because it is chemically passive and stabile in the operating range for temperature and pressure. Otherwise it has a large capacity for storing water vapor. That medium is preferably included in a container in the lamp. The container may be heated in a controlled manner so as to meter the water vapor release.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
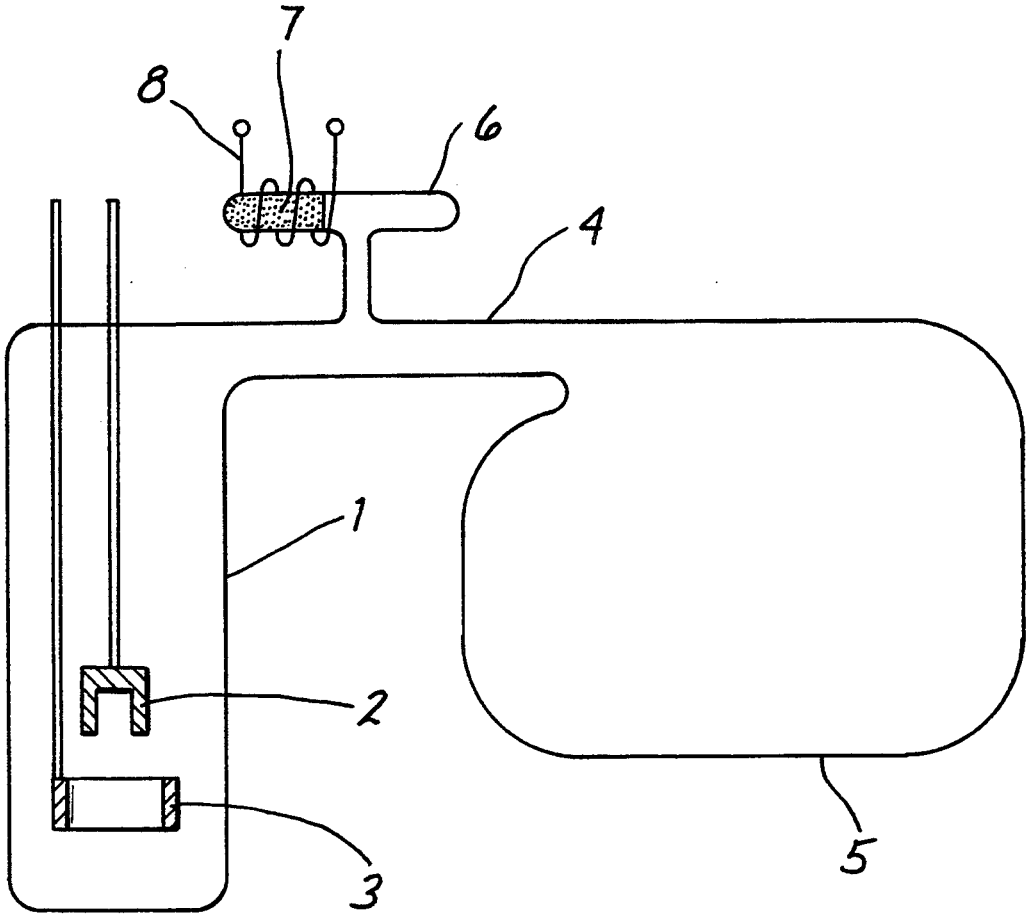
FIG. 1 is a schematic view of and into a lamp in accordance with the preferred embodiment of the invention constituting a best mode version for practicing the invention.

Proceeding to the detailed description of the drawings the figure shows a hollow cathode lamp made of a glass container or vessel 1. That bulb 1 contains a cathode 2 and an anode 3. A reservoir 5 is connected to the interior of the lamp via a duct 4. A small container 6 is connected to the duct 4 which contains manganese dioxide 7 serving as storage or storing medium for water vapor. The manganese dioxide filling can be fixed in the container 6 by means of glass wool. Reference numeral 8 denotes an electric winding or coil for heating the manganese dioxide 7 when needed.

The hollow cathode lamp is filled with a mixture of nitrogen and oxygen in a ratio as is known per se; and that mixture is enriched with water vapor. The enriching process is carried out for example by running the nitrogen oxygen mixture through a vessel filled with distilled water. This is known per se but now the partial pressure of the water vapor is adjusted through appropriately selecting the water temperature. The thus provided filling mixture that includes the nitrogen/oxygen/water vapor mixture is run through the gas discharge lamp. To the extent the manganese dioxide was not previously moistened it is now moistened by the water vapor passing through it. The pressure is then fixed to a value in the range of from 5 to 20 mbar and, through melting, the gas lamp bulb is now tightly sealed.

During operation it may occur that, owing to consumption of oxygen, the pressure in the lamp drops. In this eventuality, the manganese dioxide will release water vapor. The lamp discharge breaks down the water vapor so that oxygen is released. The amount so released being capable of being controlled additionally, through heating of the store (winding or coil 8). The release is preferably controlled so that only the consumed oxygen is replenished. That means that on a long term basis the partial pressure of oxygen remains essentially constant. That in turn increases the use life of the lamp and here particularly of the ultra violet radiation in the 200 to 300 nm range emitted by the nitric oxide as the operative parameter for measuring the desired gas concentration. As stated, the use life for measuring nitric oxide may run to about a year before the lamp must be exchanged for a new one.

The invention is not limited to the embodiments described above but all changes and modifications thereof, not constituting departures from the spirit and scope of the invention, are intended to be included.

We claim:

1. A sealed gas discharge lamp having a cathode and an anode in an enclosure that is filled with a low pressure nitrogen oxygen mixture, the improvement comprising:

the nitrogen oxygen mixture being enriched with water vapor;

a storage medium included in the lamp for storing water vapor and releasing the water vapor as the pressure in the enclosure of the lamp drops.

2. The lamp as in claim 1, the pressure being between 5 and 20 mbar.

3. The lamp as in claim 1, and including a separate vessel for the storage medium being conductively connected to and thus being a part of the lamp.

4. The lamp as in claim 1, and including means for heating the storage medium.

5. The lamp as in claim 1, the storage medium being manganese dioxide.

6. The lamp as in claim 1, said cathode being hollow so that the lamp is a hollow cathode lamp.

7. The lamp as in claim 3, the separate vessel carrying a coil for heating.

8. The lamp as in claim 7, the storage medium being manganese dioxide.

* * * * *